United States Patent [19]

Spinner

[11] Patent Number: 4,824,400

[45] Date of Patent: Apr. 25, 1989

[54] CONNECTOR FOR A COAXIAL LINE WITH CORRUGATED OUTER CONDUCTOR OR A CORRUGATED WAVEGUIDE TUBE

[76] Inventor: Georg Spinner, Am Eichberg 12, 8152 Feldkirchen-Westerham, Fed. Rep. of Germany

[21] Appl. No.: 166,106

[22] Filed: Mar. 10, 1988

[30] Foreign Application Priority Data

Mar. 13, 1987 [DE] Fed. Rep. of Germany ..... 3708242

[51] Int. Cl.[4] ..... H01R 17/04

[52] U.S. Cl. ..... 439/578

[58] Field of Search ..... 439/578–585

[56] References Cited

U.S. PATENT DOCUMENTS 2,754,487 7/1956 Carr et al. ..... 439/578

2,966,639 12/1960 Heller ..... 439/578

*Primary Examiner*—Joseph H. McGlynn

*Attorney, Agent, or Firm*—Henry M. Feiereisen

[57] ABSTRACT

A connector for a coaxial line with corrugated outer conductor or a corrugated waveguide tube includes a metal casing which has an internal circumferential groove accommodating a radially elastic helical spring ring of conducting material. The helical spring ring surrounds the outer conductor of the coaxial line or the waveguide, respectively, and is loaded in axial direction by a thrust member so as to contact a radial annular contact surface of the metal casing.

12 Claims, 3 Drawing Sheets

64a
62b
62

61a
64a
62
610

63
64b
64a
60
VIb
67
65
66
62a
62
VIa
610
612a
612
61a
61
61b

66

6

CONNECTOR FOR A COAXIAL LINE WITH CORRUGATED OUTER CONDUCTOR OR A CORRUGATED WAVEGUIDE TUBE

BACKGROUND OF THE INVENTION

The present invention refers to a connector for a coaxial line with corrugated outer conductor or a corrugated waveguide tube.

A connector in form of a plug for a coaxial line with smooth outer conductor is known from the German patent DE-PS 21 33 392 and includes a sleeve-like metal casing provided with an internal circumferential groove accommodating a radially elastic contacting member which surrounds the outer conductor or the waveguide, respectively. The contacting member is designed as laminated spring contact ring the plates of which include an inwardly directed crowning.

Although such a spring contact ring may be usable for corrugated outer conductors or corrugated waveguide tubes except for those with elliptic cross section, there are a number of drawbacks. The making of such a spring contact ring is relatively complicated, and moreover during insertion of a corrugated outer conductor with circular or helical corrugation there is the danger of undetected damages. Finally, the contact of the spring contact ring occurs at a considerable distance to the end face of the outer conductor so that the electrical length of path is increased and the reflection coefficient in particular at high or very high frequencies considerably deteriorates.

SUMMARY OF THE INVENTION

It is an object of the present invention to provide an improved connector of the above-mentioned type obviating the afore-stated drawbacks.

This object and others which will become apparent hereinafter are attained, in accordance with the present invention, by providing a helical spring ring as contacting member which is made of highly conductive material and is loaded by a thrust element axially in direction toward a radial annular contact surface of the metal casing.

The provision of a contacting member in form of a helical spring ring allows a suitably made coaxial line or corrugated waveguide tube even with elliptic cross section to be inserted merely into the pre-assembled connector and still provides a secure and intimate contact in immediate proximity of the end face of the outer conductor or waveguide independent on the kind of corrugation. Therefore, there is no need for a relevant prolongation of the electric length of path in the contacting area between the metal casing of the connector and the entry into the outer conductor or waveguide.

The thrust element may be provided in form of an elastic ring arranged between the current-free side of the helical spring ring and the adjacent wall of the groove. This elastic ring provides a secure contact between the helical spring ring and the preferably sleeve-like metal casing.

According to a further feature of the present invention, the groove may be defined by a radial shoulder of the metal casing and a L-shaped ring inserted in the metal casing and forming the thrust element. Bearing via an elastic ring at the outer end face of the L-shaped ring is an axially displacable rigid thrust member which is supported by the metal casing of the connector.

Through the provision of a L-shaped ring, a recessing within the interior of the metal casing for creating the circumferential groove becomes unnecessary.

Preferably, the elastic ring between the L-shaped ring and the thrust member is of elastic plastic material so as to assume simultaneously a strain relief when the rigid thrust member is designed e.g. as a coupling ring or a hollow screw threadably engaged with the metal casing. The elastic plastic ring can then expand in radial direction to bear closely in form-locking manner in the corrugations of the outer conductor or corrugated waveguide tube. In this manner, the interior of the metal casing is also sufficiently sealed off.

According to a preferred modification of the present invention, the helical spring ring may include spring coils tilted by a small angle relative to the radial direction. This feature allows a certain radial resilience of the helical spring ring by which the insertion of the outer conductor or the waveguide is facilitated and the requirement of narrow tolerances is avoided without marring the quality of the contact.

The helical spring ring according to the present invention can be retained in the circumferential groove prior to the assembly of the connector in especially secure manner when inserting therein a radially outwardly loaded single-coil spring lock washer.

When attaching a corrugated waveguide tube, the L-shaped ring and possibly the elastic plastic ring may be split in axial direction. This is dependent on the axial ratio and on the elasticity of the material used for the corresponding structural parts.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
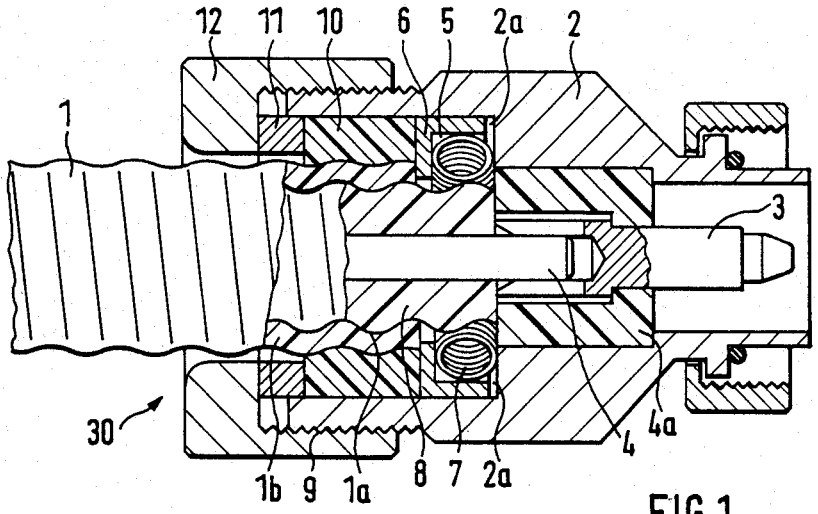
FIG. 1 is a longitudinal section of a first embodiment of a connector in accordance with the present invention illustrating a plug section thereof for a coaxial line.

Referring firstly to FIG. 1, there is shown a cross sectional view of a first embodiment of a connector 30 in accordance with the present invention. The connector 30 is illustrated in form of a plug for allowing attachment of a coaxial line 1 which includes an outer conductor 1*a* and an inner conductor 4 separated from and positioned coaxial with the outer conductor 1*a* by a dielectric 8. The connector 30 includes a sleeve-like metal casing 2 which at its front end facing away from the coaxial line 1 accommodates a plug pin 3 connected to the end of the inner conductor 4 of the coaxial line 1 in a manner not shown in detail for ease of illustration.

Figure 4A:
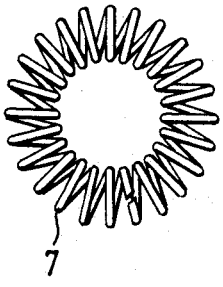
FIGS. 4*a* and 4*b* are a top view and a sectional view of a first variation of a helical spring ring in accordance with the present invention.
Figure 4B:
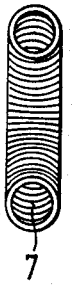
Figure 5A:
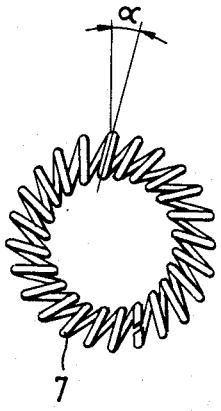
FIGS. 5*a* and 5*b* are a top view and a sectional view of a second variation of a helical spring ring in accordance with the present invention.
Figure 5B:
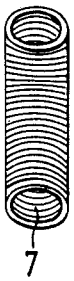

The metal casing 2 is provided with an internal circumferential grove 5 which is defined by a radial shoulder 2*a* of the metal casing 2 and a L-shaped ring 6 (FIG. 1*b*) and accommodates a helical spring ring 7. As shown in FIGS. 4*a* and 4*b*, the helical spring ring 7 may be designed in form of a conventional helical spring which is bent to an annular shape, or as shown in FIGS. 5*a* and 5*b* may be in form of a helical spring with coils tilted by a small angle $\alpha$ relative to the respective radial direction of the circle containing the helical spring ring. A tilting in this manner allows an increase of the inner diameter of the helical spring ring 7 during insertion of the outer conductor 1*a* by increasing the tilting angle $\alpha$ of the spring coils although the helical spring ring 7 bears with its outer circumference against the groove base of the groove 5 in the metal casing 2.

The helical spring ring 7 contacts the outer conductor 1*a* of the coaxial line 1 whereby the cable sheath 1*b* of the coaxial line 1 is respectively shortened. The contact between the outer conductor 1*a* and the helical spring ring 7 is obtained uniformly about the circumference of the outer conductor 1*a* in proximity of its end face bearing against an insulating sleeve 4*a* which supports the plug pin 3.

Arranged axially inwardly and bearing against the outer end face of the L-shaped ring 6 is a plastic ring 10 which is elastically deformable in particular in radial direction and which is axially compressible via an intermediate ring or shim 11 and a coupling ring 12. The L-shaped ring 6 and the plastic ring 10 define an axial thrust element by which the helical spring ring 7 is brought into contact with the radial annular shoulder or contact surface 2*a* of the metal casing 2 when threadably engaging the coupling ring 12 with the metal casing 2 via a suitable thread 9. The plastic ring 10 is then axially compressed and expands radially so that its inner circumferential surface can adapt to the contour of the corrugation of the cable sheath 1*a*. Simultaneously, the plastic ring 10 thus creates a strain relief and provides an outer seal for the connector 30.

Figure 2:
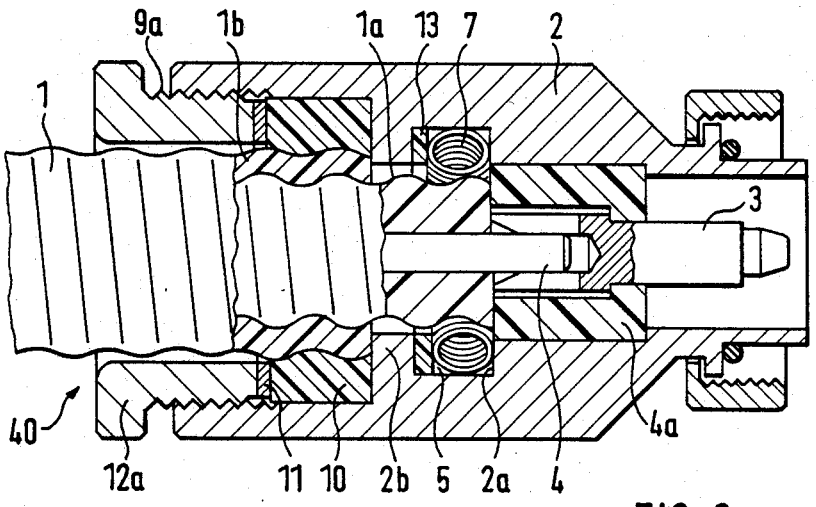
FIG. 2 is a longitudinal section of a second embodiment of a connector in accordance with the present invention illustrating a plug section thereof for a coaxial line.

FIG. 2 shows a cross sectional view of a second embodiment of a plug portion of a connector 40 in accordance with the invention. It will be readily recognized that the same reference numerals have been used in FIG. 2 as in FIG. 1 for designating corresponding parts. The circumferential groove 5 is obtained through a suitable recess in the metal casing 2 and accommodates the helical spring ring 7 which is sandwiched between the radial shoulder 2*a* and an elastic ring 13. The elastic ring 13 which is arranged at the current-free side of the helical spring ring 7 bears against an inwardly directed projection 2*b* of the metal casing 2 and defines the thrust element.

At its side remote to the circumferential groove 5, the projection 2*b* defines with the metal casing 2 a recess in which the plastic ring 10 is arranged and compressible via the shim 11 by means of a hollow screw 12*a* which is threadably engagable with the metal casing 2 via a suitable thread 9*a*. The strain relief by means of the hollow screw 12*a*, the shim 11 and the plastic ring 10 thus is attained independently of the contacting by the helical spring ring 7.

Figure 3:
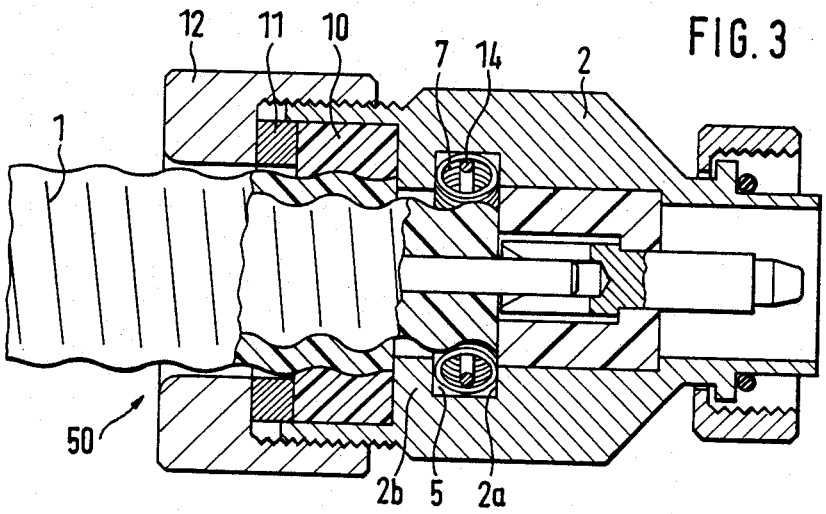
FIG. 3 is a longitudinal section of a third embodiment of a connector in accordance with the present invention illustrating a plug section thereof for a coaxial line.

FIG. 3 illustrates the plug portion of a connector 50 which differs from the previously described embodiments by the absence of a separate thrust element; rather the function thereof is assumed by the helical spring ring 7 which is dimensioned in such a manner so as to fit at slight tension in the circumferential groove 5 which is defined by the radial ring shoulder 2*a* and the projection 2*b*. In order to securely retain the helical spring ring 7 within the groove 5 when the plug has not yet been attached to the end of the coaxial line 1, a radially outwardly biased single-coil spring lock washer 14 is inserted within the helical spring ring 7.

Otherwise, the connector in the embodiment according to FIG. 3 essentialy corresponds to the connector of FIG. 1 and thus includes a plastic ring 10 which is axially compressible by the coupling ring 12 via an interposed shim 11.

Figures 1B, 6, 6A, 6B, 6C:
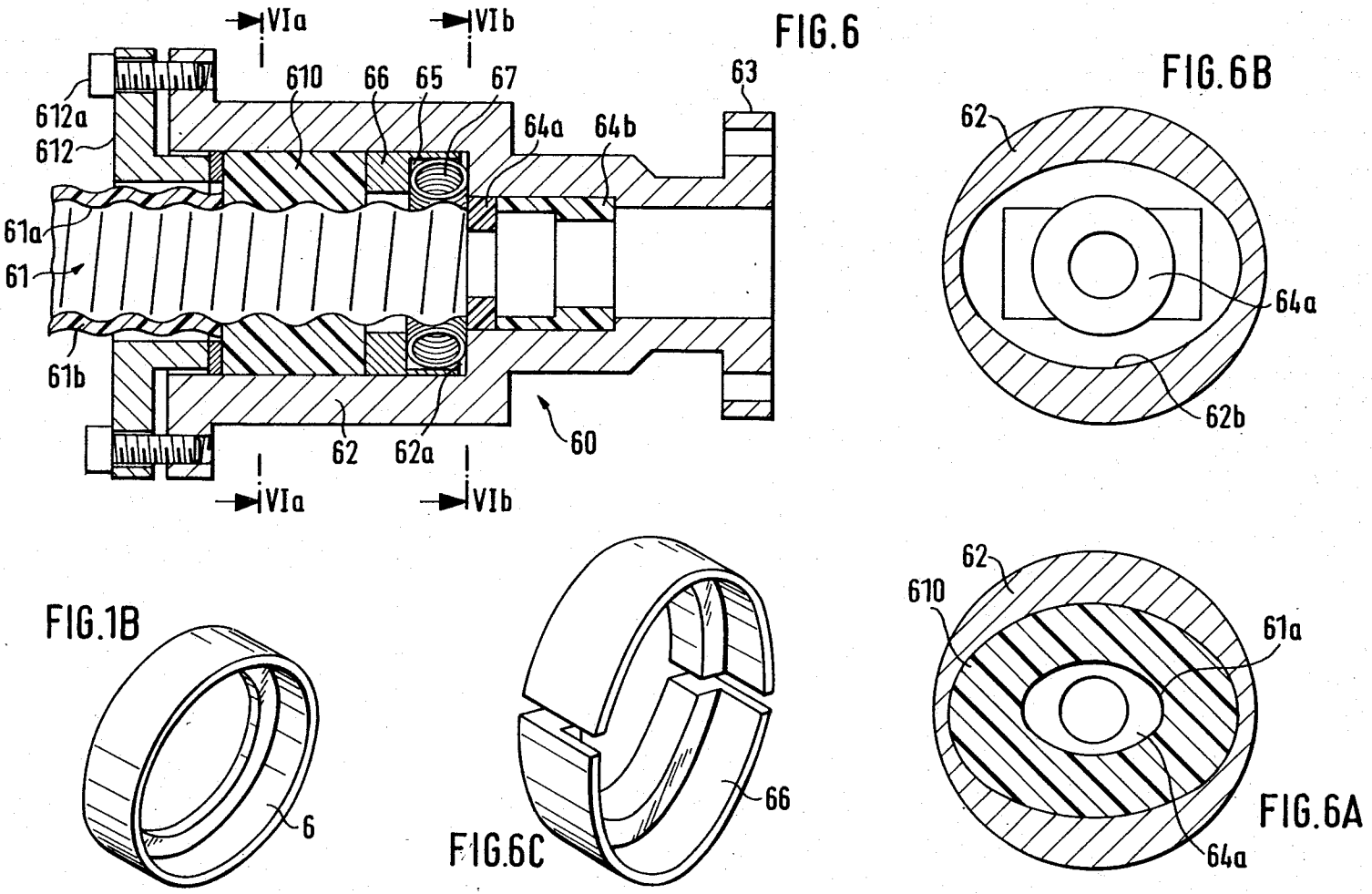
FIG. 1*b* is a perspective view of a L-shaped ring provided in the connector of FIG. 1.
FIG. 6 is a longitudinal section of a fourth embodiment of a connector in accordance with the present invention illustrating a waveguide transformer for connecting a corrugated waveguide tube of elliptic cross section with a waveguide of rectangular cross section.
FIG. 6*a* is a cross sectional view of the connector of FIG. 6 taken along the line I—I in FIG. 6.
FIG. 6*b* is a cross sectional view of the connector of FIG. 6 taken along the line II—II in FIG. 6.
FIG. 6*c* is a perspective view of a L-shaped ring provided in the connector of FIG. 6 and split in axial direction.

FIG. 6 illustrates a cross sectional view of a further connector which is designated by reference numeral 60 and is adapted for connecting a corrugated waveguide tube 61 of elliptic cross section with a waveguide of rectangular cross section. The connector 60 includes a connecting flange 63 at one end thereof for allowing attachment of the rectangular waveguide by means of suitable fasteners. For ease of illustration, the rectangular waveguide is not shown in detail.

The connector 60 which is thus simultaneously designed as a transformer with stepped plastic rings 64, 64*b* includes a sleeve-like metal casing 62 which is similarly designed in the connection area of the corrugated waveguide tube 61 as the plug in FIG. 1. In the following description, corresponding parts between the embodiment of FIG. 1 and FIG. 6 are thus designated in FIG. 6 by the same reference numeral, however with preceding numeral "6" to make reference to FIG. 6.

The connector 60 includes a helical spring ring 67 which is disposed in a circumferential groove 65 created by a respective recess in the metal casing 2. The helical spring ring 7 bears against a L-shaped ring 66 which together with the axially compressible elastic plastic ring 610 defines the thrust element. As shown in FIG. 6, the axial compression of the plastic ring 10 is accomplished by a flange 612 which includes an elliptic flange bore and is connected to the flange-like end face of the metal casing 62 via suitable screws 612*a*. By tightening the screws 612*a*, the plastic ring 610 is axially compressed and loads the L-shaped ring 66 in axial direction to create contact between the helical spring ring 7 and the radial contact surface 62*a*.

FIG. 6*a* illustrates a cross sectional view of the connector 60 taken along the line I—I in FIG. 6 and shows in more detail the elliptic cross section of the plastic ring 610 which directly bears against the outer surface 61*a* of the waveguide 61 and surrounds the latter The sheath 61*b* is thus accordingly shortened. FIG 6*b* which is a cross sectional view of the connector 60 taken along the line II—II in FIG. 6 illustrates in more detail the elliptic inner contour 62*b* of the interior space of the connector 60 with the corrugated waveguide tube received in the interior space and to be connected to a rectangular waveguide whose first plastic ring 64*a* provided for the wave transformation is shown as well.

As shown e.g. in FIG. 6*c* with regard to the L-shaped ring 66, the latter as well as the elastic ring 610 may be split in axial direction.

While the invention has been illustrated and described as embodied in a Connector for a Coaxial Line with Corrugated Outer Conductor or a Corrugated Waveguide Tube, it is not intended to be limited to the details shown since various modifications and structural changes may be made without departing in any way from the spirit of the present invention.

What is claimed as new and desired to be protected by Letters Patent is set forth in the appended claims.

I claim:

1. A connector for a coaxial line with corrugated outer conductor or a corrugated waveguide tube; comprising:

a metal casing;

contacting means arranged within said metal casing and surrounding the outer conductor or waveguide tube for contacting the latter, said contacting means including a helical spring ring of conductive material; and thrust means for urging said helical spring ring axially in direction toward a radial annular contact surface of said metal casing.

2. A connector as defined in claim 1 wherein said metal casing includes a circumferential groove in which said helical spring ring is arranged.

3. A connector as defined in claim 1 wherein said helical spring ring is a radially elastic helical spring ring.

4. A connector as defined in claim 2 wherein said thrust means includes an elastic ring arranged between said helical spring ring at the current-free side thereof and an adjacent wall of said groove.

5. A connector as defined in claim 2 wherein said thrust means includes a L-shaped ring disposed in said metal casing and an elastic ring bearing against said L-shaped ring, said circumferential groove being defined by the radial annular contact surface of said metal casing and said L-shaped ring.

6. A connector as defined in claim 5, and further comprising fastening means engagable with said metal casing and displacable in axial direction thereof, said fastening means including a rigid thrust element bearing against an outer end face of said L-shaped ring via said elastic ring.

7. A connector as defined in claim 5 wherein said elastic ring is made of plastic material.

8. A connector as defined in claim 1 wherein said helical spring ring includes spring coils tilted about an angle in radial direction.

9. A connector as defined in claim 1, and further comprising a single-coil spring locker washer which is radially outwardly biased.

10. A connector as defined in claim 5 wherein said L-shaped ring is split in axial direction.

11. A connector as defined in claim 5 wherein said elastic ring is split in axial direction.

12. A connector as defined in claim 1 wherein said metal casing is a sleeve-like metal casing.

* * * * *

UNITED STATES PATENT AND TRADEMARK OFFICE

CERTIFICATE OF CORRECTION

PATENT NO. : 4,824,400

DATED : April 25, 1989

INVENTOR(S) : GEORG SPINNER

It is certified that error appears in the above-identified patent and that said Letters Patent is hereby corrected as shown below:

Column 2, line 63, delete "I-I" and substitute therefor -- VIa-VIa --;

Column 2, line 65, delete "II-II" and substitute therefor -- VIb-VIb --;

Column 4, line 60, delete "I-I" and substitute therefor -- VIa-VIa --;

Column 4, line 66, delete "II-II" and substitute therefor -- VIb-VIb --.

Signed and Sealed this

Fifteenth Day of May, 1990

*Attest:*

*Attesting Officer*

HARRY F. MANBECK, JR.

*Commissioner of Patents and Trademarks*